US006480613B1

(12) United States Patent
Choi

(10) Patent No.: US 6,480,613 B1
(45) Date of Patent: Nov. 12, 2002

(54) LOUDSPEAKER STAND

(76) Inventor: Tony Tzi Chan Choi, Flat F, 24th Floor, Hong Wang Court, 192 Tsat Tsz Mui Road, North Point (HK)

( * ) Notice: Subject to any disclaimer, the term of this patent is extended or adjusted under 35 U.S.C. 154(b) by 0 days.

(21) Appl. No.: 09/472,526

(22) Filed: Dec. 27, 1999

(51) Int. Cl.[7] ..... H04R 25/00

(52) U.S. Cl. ..... 381/386; 381/333; 381/334; 381/385; 381/387; 381/388; 181/178; 181/179

(58) Field of Search ..... 381/87, 334, 374, 381/383, 385, 386, 387, 388, 390, 333, 362; 181/178, 179; 362/806, 97, 157, 3, 382; 356/68

(56) References Cited

U.S. PATENT DOCUMENTS 817,457 A * 4/1906 Turner
2,547,532 A * 4/1951 Mendelsohn
3,820,752 A * 6/1974 Oram
4,445,005 A * 4/1984 Furuhashi
4,494,177 A * 1/1985 Matthews
4,597,469 A * 7/1986 Nagashima
4,744,019 A * 5/1988 Krogsrud
5,201,896 A * 4/1993 Kruszewski
6,130,953 A * 6/1998 Wilton

* cited by examiner

*Primary Examiner*—Curtis Kuntz
*Assistant Examiner*—Dionne Harvey
(74) *Attorney, Agent, or Firm*—Jackson Walker L.L.P.

(57) ABSTRACT

A loudspeaker set comprises three loudspeakers 29, 30 and 31 for use with a PC having a monitor 24. The loudspeaker 31 is stationary and mounted on the monitor 24. The loudspeakers 29 and 30 are mounted on foldable stands 22 and 23 that enable these loudspeakers to be moved and held at either side of a listener's head 28 for use. The stands each consist of three pivotably connected hollow limbs that enable the loudspeakers to move horizontally and vertically with respect to a top of a table 27 into the position shown in the Figure. When not in use, the stands fold up with the limbs in line to store the loudspeakers 29 and 30 at the sides and behind the monitor 24.

8 Claims, 3 Drawing Sheets

LOUDSPEAKER STAND

BACKGROUND OF THE INVENTION

1. Field of the Invention

The invention relates to loudspeaker stands.

2. Description of the Prior Art

In modern sound reproduction systems, it is preferable to have a number of separately driven loudspeakers to provide a "surround sound system". That means that the loudspeakers are placed around a room (or person) to give an all round sound effect. In a small space, headsets may be used which usefully confine the sounds to adjacent the listener's ears. However headsets tend to cut-off the bass of the sound and also wearing headsets isolates the listener from normal sounds in the room space. It can also be uncomfortable to wear headsets and it is otherwise generally restricting for the listener who may wish to carry out other tasks while listening to music, say.

SUMMARY OF THE INVENTION

It is an object of the invention to overcome or at least reduce this problem

According to the invention there is provided a loudspeaker stand comprising three or more elongate limbs of generally the same length pivotably joined together end-to-end to form the stand in which the limbs are arranged to fold together in line for storage in one configuration, an anchor bracket at one of the stand to support the stand to a fixture in use and a support at an opposite end to fit to a loudspeaker, wherein, in use, one limb is arranged to pivot through a vertical plane and one limb is arranged to pivot through a horizontal plane.

There are preferably three limbs, in which one limb pivots in a vertical plane, and the other two limbs pivot in a horizontal plane.

A first limb is preferably pivotably connected to the anchor bracket to pivot in a vertical plane.

Each pivotable joint may be provided with manually releasable locking means arranged to lock a respective joint in a chosen angular position.

The anchor bracket may have a releasable clamp arranged to releasably clamp the anchor to an article of furniture.

The anchor bracket may have a platform to support a second loudspeaker on the anchor bracket.

Two loudspeaker stands may be arranged to be used together and extend to either side of a head of a listener in use. The two loudspeaker stands may be mounted on a common planar base plate.

BRIEF DESCRIPTION OF THE DRAWINGS

Loudspeaker stands according to the invention will now be described by way of example with reference to the accompanying diagrammatic drawings in which.

DESCRIPTION OF THE PREFERRED EMBODIMENTS

Figure 1:
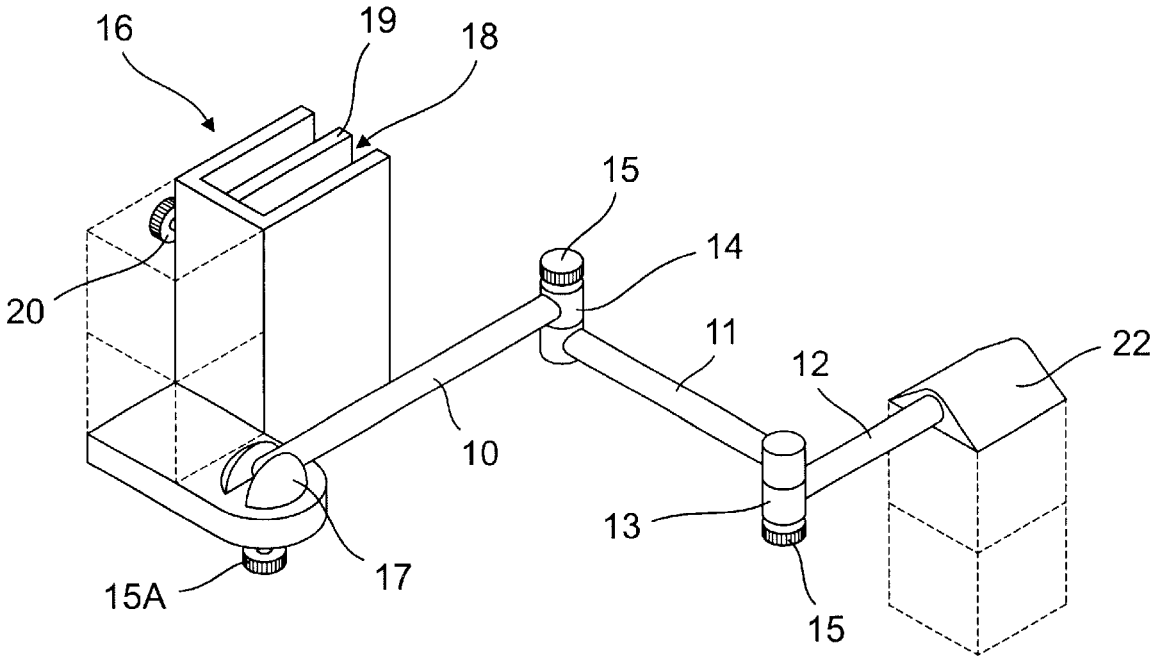
FIG. 1 is an isometric view of a stand in a partially expanded configuration.
Figure 2:
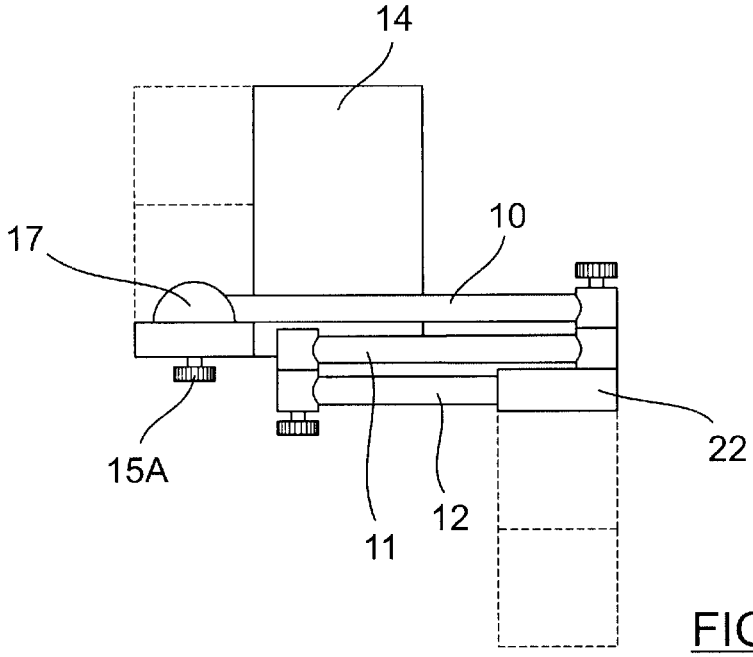
FIG. 2 is a side view of the stand in a folded configuration.

Referring to the drawings, in FIGS. 1 and 2, a right side loudspeaker stand comprises three hollow limbs 10, 11 and 12 each about 25 cm long. The limbs are joined together end-to-end by pivotable joints 13 and 14. The joints 13 and 14 allow the limbs to rotate in horizontal planes in use and can be releasably locked manually in chosen relative orientations using nuts 15.

The limb 10 is pivotably connected at one end to an anchor bracket 16 by a relatively stiff joint 17 that allows the limb 10 to rotate about a vertical plane. The joint 17 may alternatively be the same as the joints 13 and 14 and provided with a tightening nut 15A, if preferred.

The anchor bracket 16 has a channel 18. A movable plate 19 is mounted in the channel 18 and is adjusted by a manually rotatable screw 20 that alters the effective width of the channel. In use, the channel 18 is offered up to a table leg and the screw 20 turned to move the plate 19 so as to clamp the anchor bracket 16 to the table leg. At a remote end of the stand, there is a platform 22 for supporting a loudspeaker.

It will be appreciated that once the bracket 16 is clamped to the table leg, the loudspeaker can be swung vertically and horizontally with respect to the bracket 16. This allows the loudspeaker to be easily positioned and supported in a desired position at one side of a head (opposite an ear) if a listener seated at the table.

FIG. 2 shows the configuration for storing the loudspeaker stand when not in use, where the limbs 10, 11 and 12 are folded together over themselves in one plane. In the folded configuration, it will be noted that the stand is only about 25 cm in length and so takes up very little space. This is an important feature of embodiments of the invention because the loudspeaker stands are for use in relatively small spaces and yet enable efficient and all round listening to be provided. In use, the loudspeaker can be positioned generally in line, opposite and suitably close to ears of a listener.

Supply cables (not shown) for the loudspeakers are conveniently threaded into and hidden from interference and view, within the limbs 10, 11 and 12.

Figure 3:
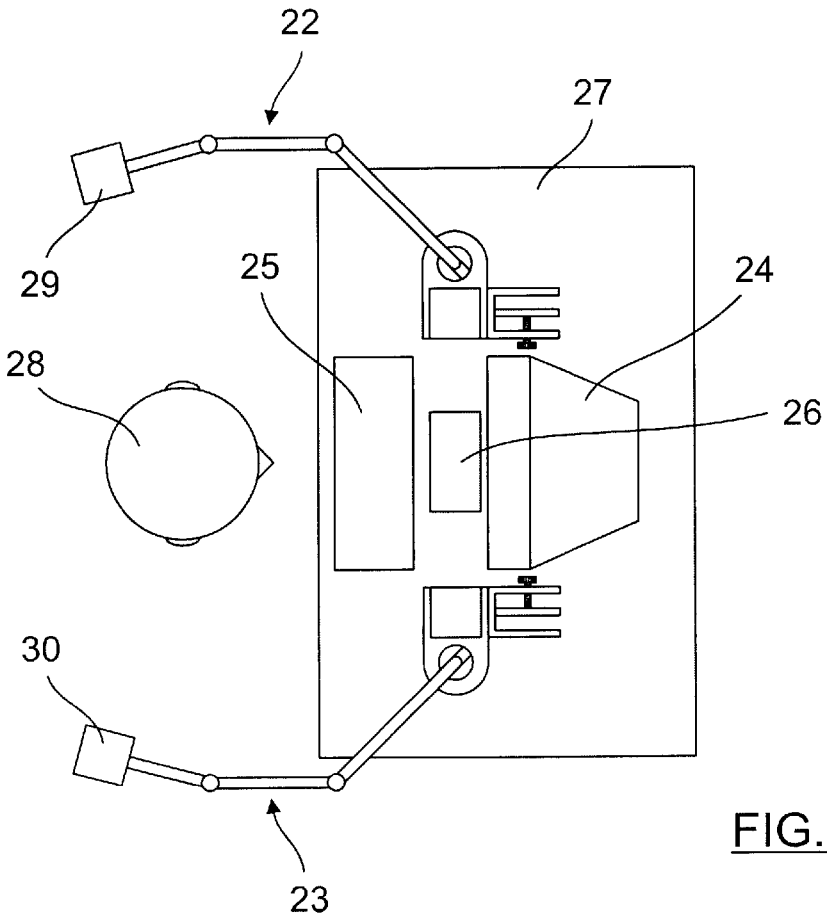
FIG. 3 is a plan view of a loudspeaker set in a fully expanded configuration.
Figure 4:
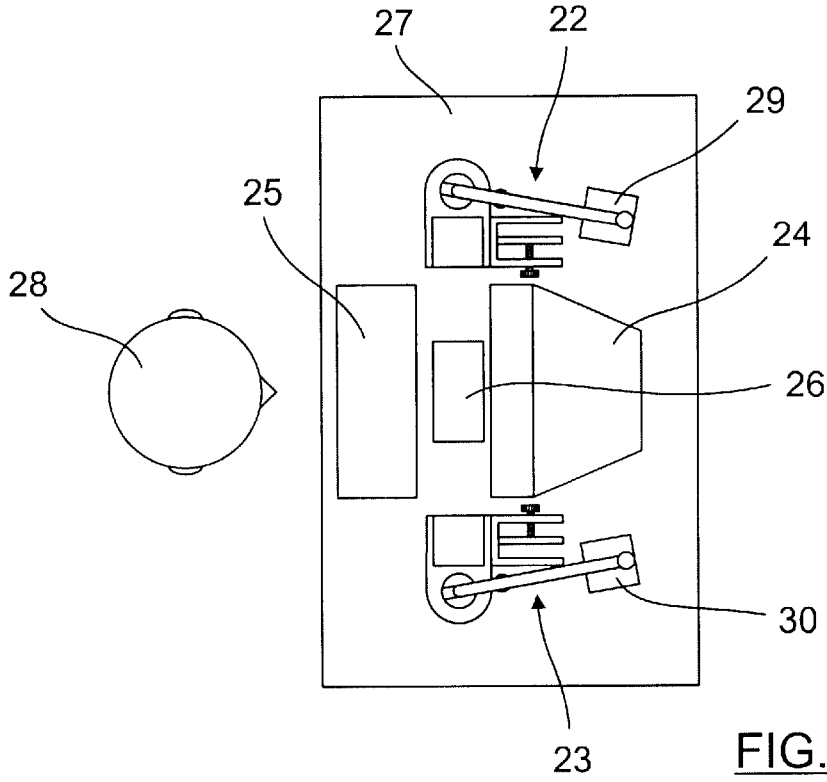
FIG. 4 is a plan view showing the loudspeaker set in a folded configuration.

In FIGS. 3 and 4, a sound system arrangement is shown having two loudspeaker stands 22 and 23, each formed of the stands shown in FIGS. 1 and 2. In FIGS. 3 and 4, a PC monitor 24, a keyboard 25 and a central loudspeaker 26 are supported on a computer table 27. The loudspeaker stands are also suitably anchored on the top of the table. A listener's head 28 is shown.

In FIG. 3, loudspeakers 29 and 30 supported by the stands are positioned opposite ears of the listener's head 28 for providing all round listening of music played by the PC. A central loudspeaker 31 is stationary and mounted on top of the PC monitor 24.

In FIG. 4, the loudspeaker stands 22 and 23 are folded away for storage.

Figure 5:
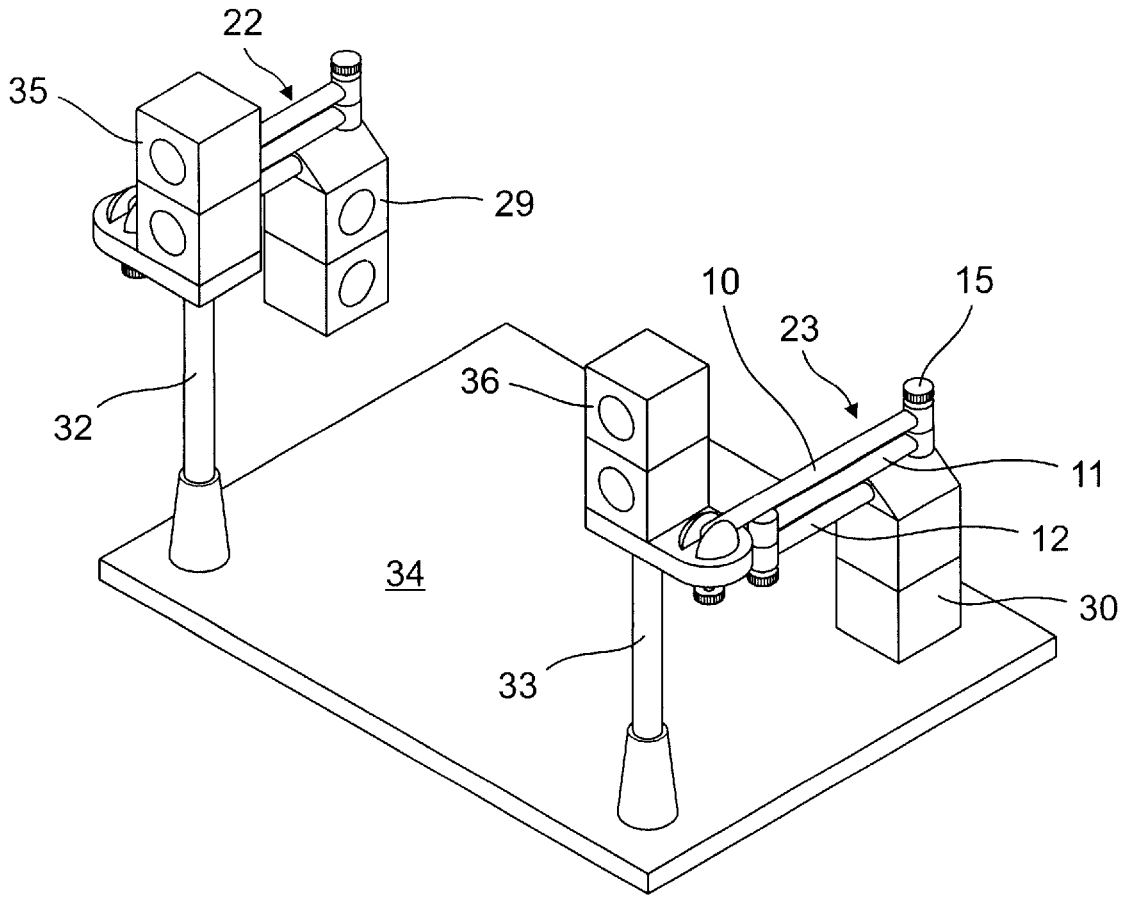
FIG. 5 is an isometric top view of another loudspeaker set.

In FIG. 5, a somewhat different all round music speaker system is shown. The loudspeaker stands 22 and 23 are anchored to respective columns 32 and 33 mounted to a common base plate 34. Extra loudspeakers 35 and 36 are supported on the tops of the columns 32 and 33.

It will be noted, as explained, that one limb, the limb 10, is constrained to pivot, or rotate, through a vertical plane, whereas another one limb, the limb 11, is constrained to pivot through a horizontal plane. The pivotable arrangement of the limb 12, or other limbs if present, could be vertical or horizontal. It is sufficient to allow for required three dimensional movement of the loudspeakers, 29 and 30, for two degrees of movement, vertical and horizontal, to be catered for. The limbs 10. 11 and 13 are made of effectively about the same lengths to make the folded configuration as practically small as possible for any given overall expanded length of stand. In practice, the described arrangements are however much preferred, where three limbs are used, because required vertical movement is likely to be about one third of the horizontal movement required to bring the loudspeakers out and opposite the ears of a seated listener in a relatively confined space.

I claim:

1. A loudspeaker stand comprising three or more elongate limbs generally the same length pivotally joined together end-to-end to form the stand in which the limbs are arranged to fold over themselves for storage in one plane, an anchor bracket at one end of the stand to support the stand to a fixture in use and a support at an opposite end to fit to a loudspeaker, wherein, in use, one limb is arranged to pivot through a vertical plane and one limb is arranged to pivot through a horizontal plane.

2. A loudspeaker stand according to claim 1, in which there are three limbs one limb pivots in a vertical plane, and the other two limbs pivot in a horizontal plane.

3. A loudspeaker stand according to claim 2, in which a first limb is pivotably connected to the anchor bracket to pivot in a vertical plane.

4. A loudspeaker stand according to claim 1, in which each pivotable joint is provided with manually releasable locking means arranged to lock a respective joint in a chosen angular position.

5. A loudspeaker stand according to claim 1, in which the anchor bracket has a releasable clamp arranged to releasably clamp the anchor to an article of furniture.

6. A loudspeaker stand according to claim 1, further comprising a platform attached to the anchor bracket, the platform having at least one column to support a second loudspeaker on the loudspeaker stand.

7. A loudspeaker stand set comprising two loudspeaker stands according to claim 1, arranged to be used together and extend to either side of a head of a listener in use.

8. A loudspeaker stand set comprising two loudspeaker stands according to claim 1, mounted on a common planar base plate.

* * * * *